United States Patent [19]

Bailey

[11] 4,225,134

[45] Sep. 30, 1980

[54] TARGET ASSEMBLY FOR GAMES

[75] Inventor: Dennis Bailey, Greenwood, Ark.

[73] Assignee: Spang Industries, Inc., Butler, Pa.

[21] Appl. No.: 951,309

[22] Filed: Oct. 13, 1978

[51] Int. Cl.[3] ..... A63B 71/00

[52] U.S. Cl. ..... 273/127 R; 273/121 A

[58] Field of Search ..... 273/127 R, 118 A, 127 B, 273/125 A, 123 A, 119 A, 120 A, 121 A, 122 A, 126 A, 124 A; 200/61.11, 85 R, 61.1

[56] References Cited

U.S. PATENT DOCUMENTS

| | | | |
|---|---|---|---|
| 2,120,440 | 6/1938 | Kramer et al. | 273/121 A |
| 2,144,240 | 1/1939 | Breitenstein | 273/118 A |
| 2,212,097 | 8/1940 | Gensberg | 200/61.11 |
| 2,222,403 | 11/1940 | Chouinard | 273/121 A |
| 2,585,153 | 2/1952 | Metz | 273/126 A |
| 3,063,719 | 11/1962 | Rosenberger | 273/126 A |
| 3,348,844 | 10/1967 | Lemelson | 273/121 A |

*Primary Examiner*—Richard C. Pinkham
*Assistant Examiner*—T. Brown
*Attorney, Agent, or Firm*—Reed, Smith, Shaw & McClay

[57] ABSTRACT

A target assembly for use in games for personal entertainment and particularly pinball games, in which an electrically conductive ball traverses the base layer of a game board said base layer being electrically insulated from a contact plate. A multiscore plate is electrically connected to the contact plate and has a plurality of fingers that extend into a channell formed between the multiscore plate and a guide member such that, when the ball traverses the channel, it contacts the fingers of the multiscore assembly to complete an electrical current path between the contact plate and the base layer to trigger a scoring mechanism.

7 Claims, 2 Drawing Figures

TARGET ASSEMBLY FOR GAMES

BACKGROUND OF THE INVENTION

1. Field of the Invention

The presently disclosed invention relates to games of personal entertainment and, in particular, pinball games.

2. Description of the Prior Art

Among games of personal enjoyment, games in which a ball is made to traverse a playing surface have found particularly wide acceptance. These games have a wide range of imaginative objects, the attainment of which constitutes successful performance of the game. Considered to be generally illustrative in U.S. Pat. No. 2,144,240 to C. J. Breitenstein in which the weight of an appropriately positioned ball forces an electrical switch closed, thus energizing a scoring register or similar auxiliary means.

More recently, the balls have tended to be electrically conductive and at least portions of the playing surface have also been electrically conductive such that the ball completes a current path between the electrically conductive portion of the playing surface and a terminal that is at a voltage potential different than that of the playing surface to activate a scoring register or other auxiliary mechanism. U.S. Pat. No. 3,348,844 to J. H. Lemelson is considered to be generally illustrative.

Many of the games which have employed an electrically conductive ball on a conductive playing surface have been "static" in that, in the operation of the game, there are few if any parts other than the ball that experience mechanical motion. However, it has been found that games capable of mechanical movement or "active" games have enjoyed wider public acceptance than such static games. Therefore, it has been commercially desirable to include mechanically active devices in such games. The mechanical devices used in such games are subject to considerable wear and, consequently, have generally tended to be complex and expensive.

The complexity and expense of these mechanical devices has generally tended to restrict their application to games intended for commercial use. More recently, however, these games in general and especially pinball games, have found a growing market for private use by the individual consumer. In order that they be salable, the games intended for private use must be less expensive than the commercial models which are considered a capital investment. Nevertheless, it has been found that games intended for private enjoyment have wider acceptance when they include active mechanisms of various types.

With particular reference to prior art pinball games intended for private enjoyment, active mechanisms have been used for triggering auxiliary circuits such as scoring register circuits. These active mechanisms include multiple triggering devices in which the ball passes through a channel or similar pathway to activate the mechanism a multiple of times. However, cost limitations on these mechanisms have generally resulted in their rapid wear and unreliability.

Accordingly, there existed a need for an active mechanism for use on games, such as pinball games, which was inexpensive enough to be applied to games intended for private use, yet durable enough to afford the purchaser a reasonable use expectancy. More particularly, there was a need for a multiple triggering mechanism that could be substituted for previous multiple triggering mechanisms that were found to have unacceptably low operation lifetimes.

SUMMARY OF THE INVENTION

In accordance with the present invention, a target assembly is provided for use in games in which a ball traverses a game board having a contact plate and a base layer that are electrically isolated by an insulator layer. The target assembly includes a guide member that extends out of the major plane of the game board and restricts movement of the ball in at least one direction. A multiscore plate is disposed above the playing surface of the game board and adjacent to the guide member such that a channel is formed between the multiscore plate and the guide member. The multiscore plate is provided with a plurality of fingers extending into the channel and is electrically connected to the contact plate such that a ball passing through the channel contacts the fingers to close an electrical current path between the contact plate and the base layer.

Preferably, the electrical connection between the multiscore plate and the contact plate is comprised of a fulcrum upon which the multiscore plate is balanced such that the fingers are maintained above the base layer.

Also preferably, the guide member comprises at least a portion of a housing that covers the multiscore plate and at least a portion of the game board.

In accordance with the present invention, a target assembly is provided which is economical and reliable so that it is suitable for use in pinball games and similar games that are intended for private use. Other details, objects and advantages of the present invention will become apparent as the following description of the presently preferred embodiment of the same proceeds.

BRIEF DESCRIPTION OF THE DRAWING

In the accompanying drawings, the presently preferred embodiments of the invention are shown in which.

PREFERRED EMBODIMENT OF THE INVENTION

Figure 1:
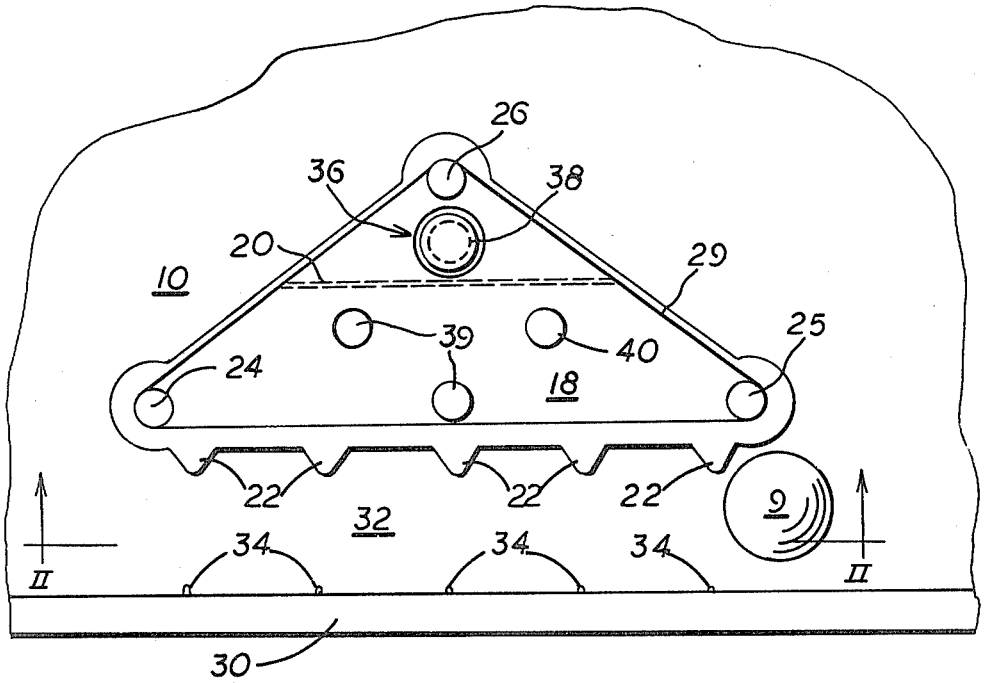
FIG. 1 is a plan view of a portion of a game that includes the disclosed target assembly.
Figure 2:
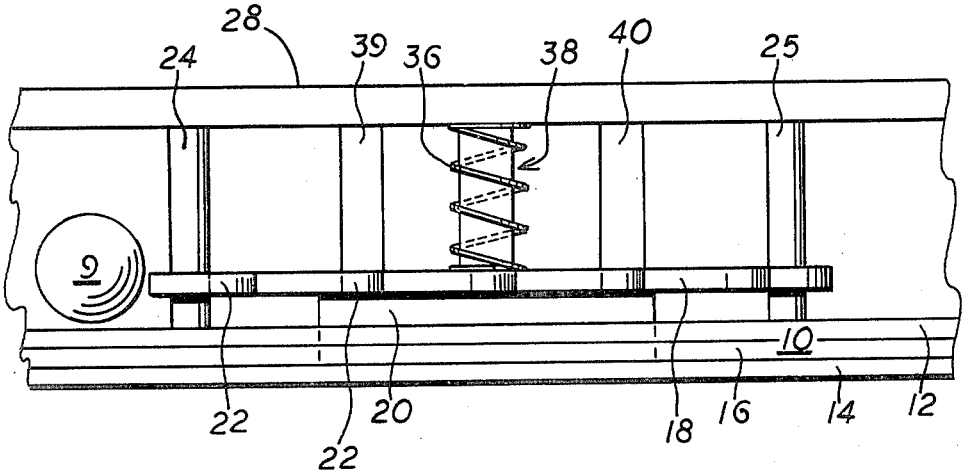
FIG. 2 is a side elevation of the disclosed target assembly as viewed through cross-section II—II of FIG. 1.

The game shown in FIGS. 1 and 2 includes a ball 9 that freely traverses the exposed surface of a game board 10 having a major plane parallel to the plane of FIG. 1 and normal to the plane of FIG. 2. Preferably, the major plane of game board 10 is inclined with respect to the horizontal. Game board 10 includes a base layer 12 and a contact plate 14 which are electrically isolated by an insulation layer 16. Base layer 12 and contact plate 14 form a normally open switch through which a power source (not shown) activates a scoring register or similar apparatus (not shown).

The preferred target assembly is disposed on the surface of game board 10 and includes a multiscore plate 18 having a fulcrum 20 and fingers 22. Multiscore plate 18 is electrically connected to contact plate 14 through fulcrum 20. Fulcrum 20 is electrically isolated from base layer 12 and electrically connected to contact plate 14 through insulation layer 16. Multiscore plate 18 is balanced on fulcrum 20 such that fingers 22 are maintained above the base layer. Since base layer 12 and contact plate 14 form a normally open switch through which a power source (not shown) activates scoring register or similar apparatus (not shown) and since contact plate 14 is electrically connected to Multiscore plate 18, completion of an electrical current path between multiscore plate 18 and base layer 12 causes the power source to energize the scoring register.

Multiscore plate 18 is laterally maintained on game board 10 by guide posts 24–26. Preferably, guide posts 24–26 further serve to support a housing 28 that covers the multiscore plate 18 and at least the adjacent area of playing surface 10. Also preferably, the target assembly includes an elastic band 29 that encompasses guide post 24–26 and diverts ball 9 from entry upon the upper surface of multiscore plate 18.

A guide member 30 located on game board 10 adjacent multiscore plate 18, extends above the major plane of game board 10 so as to restrict at least one direction of motion of ball 9 on the surface of game board 10. Guide member 30 extends laterally with respect to the side of multiscore plate 18 from which fingers 22 project so as to form a channel 32 between multiscore plate 18 and guide member 30. Preferably, guide member 30 comprises a portion of housing 28, such as a sidewall of housing 28.

Multiscore plate 18 is disposed with respect to guide member 30 such that channel 32 is sufficiently wide to accomodate the passage of ball 9. At the same time, channel 32 is narrow enough that, as the ball progresses through channel 32, it necessarily contacts fingers 22. Preferably, guide member 30 is provided with an array of ribs 34 that are located along channel 30 at positions oppositely disposed from fingers 22 and extend into said channel such that ribs 34 direct ball 9 into fingers 22 as ball 9 rolls through channel 32.

The target assembly is further provided with a counterbalance spring 36 compressed between multiscore plate 18 and housing 28 and located concentrically about a post 38. Counterbalance spring 36, together with a stop post 39 located between multiscore plate 18 and contact plate 14, and guide posts 39 and 40 which depend from housing 28, provide a means for balancing multiscore plate 18 on fulcrum 20 such that, in the normal position of multiscore plate 18, fingers 22 are disposed away from base layer 12. Multiscore plate 18 is thereby maintained in a plane parallel adjacent to the surface of base layer 12.

In the operation of the target assembly, the scoring register is activated a multiple of times as ball 9 proceeds through channel 32 and successively contacts fingers 22. As explained previously, the diameter of channel 32 in relation to the diameter of ball 9 is such that ball 9 cannot proceed through channel 32 without contacting fingers 22. Upon contacting fingers 22, ball 9 tends to ride up over fingers 22. As ball 9 begins to ride up over fingers 22, the weight of ball 9 is sufficient to overcome the force of counterbalance spring 36 thereby bringing fingers 22 into contact with the surface of base layer 12. A current path between contact plate 14 and base layer 12 is thus provided so as to energize the scoring register. As ball 9 proceeds through channel 32, it encounters each of fingers 22 in succession, thereby repeatedly bringing multiscore plate 18 into contact with base layer 12 and repeatedly energizing the scoring register in accordance with the total number of fingers 22 on multiscore plate 18.

In an alternative embodiment, ball 9 is made of an electrically conductive material such that as ball 9 proceeds through channel 32, it contacts fingers 22 or portions of the edge of multiscore plate 18 to complete a current path between multiscore plate 18 and base layer 12 through ball 9. The scoring register is therefore activated each time ball 9 contacts multiscore plate 18.

Accordingly, the target assembly herein disclosed is reliable yet economical enough for use in pinball games and similar games intended for private use. While a present preferred embodiment of the invention has been described, it is to be understood that the scope of the invention is not limited thereto but can be otherwise variously embodied within the scope of the following claims.

I claim:

1. A target assembly for use in games in which an electrically conductive ball traverses a game board having a contact plate layer, a base layer, and an insulator layer that electrically isolates the contact plate layer from the base layer such that the base layer and the contact plate form a normally open switch, said assembly comprising:

a guide member that extends out of the major plane of said game board, said guide member restricting the motion of the ball on the playing board in at least one direction; and a multiscore plate disposed adjacent to the surface of said game board at a location adjacent to said guide member to form a channel between said multiscore plate and said guide member, said multiscore plate having a plurality of fingers extending into said channel, said multiscore plate being electrically connected to said contact plate layer and electrically isolated from said base layer such that, when the ball contacts the fingers, an electrical current path is closed between said contact plate layer and said base layer.

2. The target assembly of claim 1 wherein said guide member further includes an array of ribs that extend into said channel and direct the ball into the fingers of the multiscore plate as the ball rolls through the channel.

3. The target assembly of claim 2 wherein said guide member comprises at least a portion of the sidewall of a housing that covers the multiscore plate and at least a portion of the game board.

4. The target assembly of claim 2 wherein the electrical connection between said multiscore plate and the contact plate layer is comprised of a fulcrum, said target assembly further comprising:

means for balancing the multiscore plate on the fulcrum such that, in a balanced position, the fingers do not contact the base layer.

5. The target assembly of claim 4 further comprising: guide posts for laterally maintaining the multiscore plate on the game board.

6. The target assembly of claim 5 wherein said balancing means comprises a spring compressed between the multiscore plate and the portion of the housing covering the game board.

7. The target assembly of claim 6 further comprising: an elastic band encompassing said guide posts, said band diverting the direction of the ball from entry upon portions of the multiscore plate.

* * * * *